United States Patent [19]

Sutliff et al.

[11] 3,980,146

[45] Sept. 14, 1976

[54] FISHING TOOL ENERGIZER AND POLYMER ENERGY STORAGE ELEMENT EMBODIED THEREIN

[76] Inventors: Wayne N. Sutliff; Jim L. Downen, both of 2931 Pierce Road, Bakersfield, Calif. 93308

[22] Filed: June 19, 1975

[21] Appl. No.: 588,377

[52] U.S. Cl. ..... 175/299; 267/141

[51] Int. Cl.[2] ..... E21B 1/10

[58] Field of Search ..... 175/299, 296, 321; 267/125, 140, 141, 137, 153, 151

[56] References Cited

UNITED STATES PATENTS

| | | | |
|---|---|---|---|
| 3,515,382 | 6/1973 | Gallagher | 267/153 |
| 3,539,026 | 11/1970 | Sutliff | 175/299 |
| 3,735,828 | 5/1973 | Berryman | 175/299 |
| 3,750,423 | 8/1973 | Williams | 267/141 |

*Primary Examiner*—James A. Leppink
*Attorney, Agent, or Firm*—Dana E. Keech

[57] ABSTRACT

A deep well elastic-tensile energy storage tool provided for incorporation in a drill string just above a fishing tool assembly, the latter embracing a fishing tool for directly engaging the fish, a conventional jar and one or more drill collars in the order named; said energy storage tool incorporating a cylindrical tubular column of molded polyurethane which is compressible axially one-twelfth its length to develop therein an internal reaction force of up to 125,000 pounds which is released by the jar for sudden application to the fish in a jarring operation.

7 Claims, 11 Drawing Figures

FISHING TOOL ENERGIZER AND POLYMER ENERGY TORAGE ELEMENT EMBODIED THEREIN

SUMMARY OF THE INVENTION

This invention is an improvement over the tool shown in our prior U.S. Pat. No. 3,539,026 which issued Nov. 10, 1970 and in which energy is stored in a stack of dished steel washer springs known commercially as Belleville washers. This patented tool has been very successful but the space demanded by the spring washers restricted the diameter of the central flow passage of the tool and eliminated its use with equipment recently developed for chemically cutting oil well casings in which central flow passages up to forty percent of the OD of the tool are demanded.

Efforts by tool designers to meet this demand have resulted in fishing tool energizers being offered employing compressed air and compressed nitrogen as the elastic energy storage medium in the tool. Difficulty has been experienced in controlling the compressed gases under the extremely high pressures to which said gas is subjected in the operation of the tool in the well. In one instance, two workmen were seriously injured by an explosion of the tool when it was being disassembled in an accident causing one of these workers to lose a leg. As a result of these accidents, serious consideration was given by the Industrial Safety Commissioner of Texas to forbid further use of these tools.

In our research for a safe elastic energy storage medium for incorporation in a fishing tool energizer, the following objects were pursued:

First, an element was required which could be confined in small enough space in the tool which would allow a central fluid passage through the tool occupying over forty percent of the OD of the tool.

Second, such a medium had to be proof against exploding and thus hazarding the lives and safety of the working crews.

A third object of the invention was to provide a powering element for the tool which is substantially less expensive than the column of spring washers and thus measurably reduce the cost of the tool.

A fourth object of the invention was to provide a fishing tool energizer with a power element which can be readily repaired in the field wherever a lathe is available.

All of the foregoing objects have been realized in the present invention by building the fishing tool energizer comprised therein around a tubular solid elastic element molded of a polymer with a durometer hardness within the range of 80 to 100 and preferably between the limits of 85 to 95 and with said polymer being preferably what is commonly known as "double bond" polyurethane. This element, when only 48 inches long and confined with proper clearances within the chamber provided therefor in the energizer of the invention, yields to axial pressure applied thereto of approximately 70,000 pounds by a distortion of less than 4 inches in the length of the element without the element sticking to the walls of said chamber, said element upon the release of said pressure, instantly expanding to its full original length with a release lengthwise of the energy applied to compressing said element.

Field tests of the invention have demonstrated its capacity to endure numerous repetitive jarring operations without appreciable damage being done to the energy storage element of the tool.

DETAILED DESCRIPTION OF THE PREFERRED EMBODIMENT

Figures 1, 2, 3:
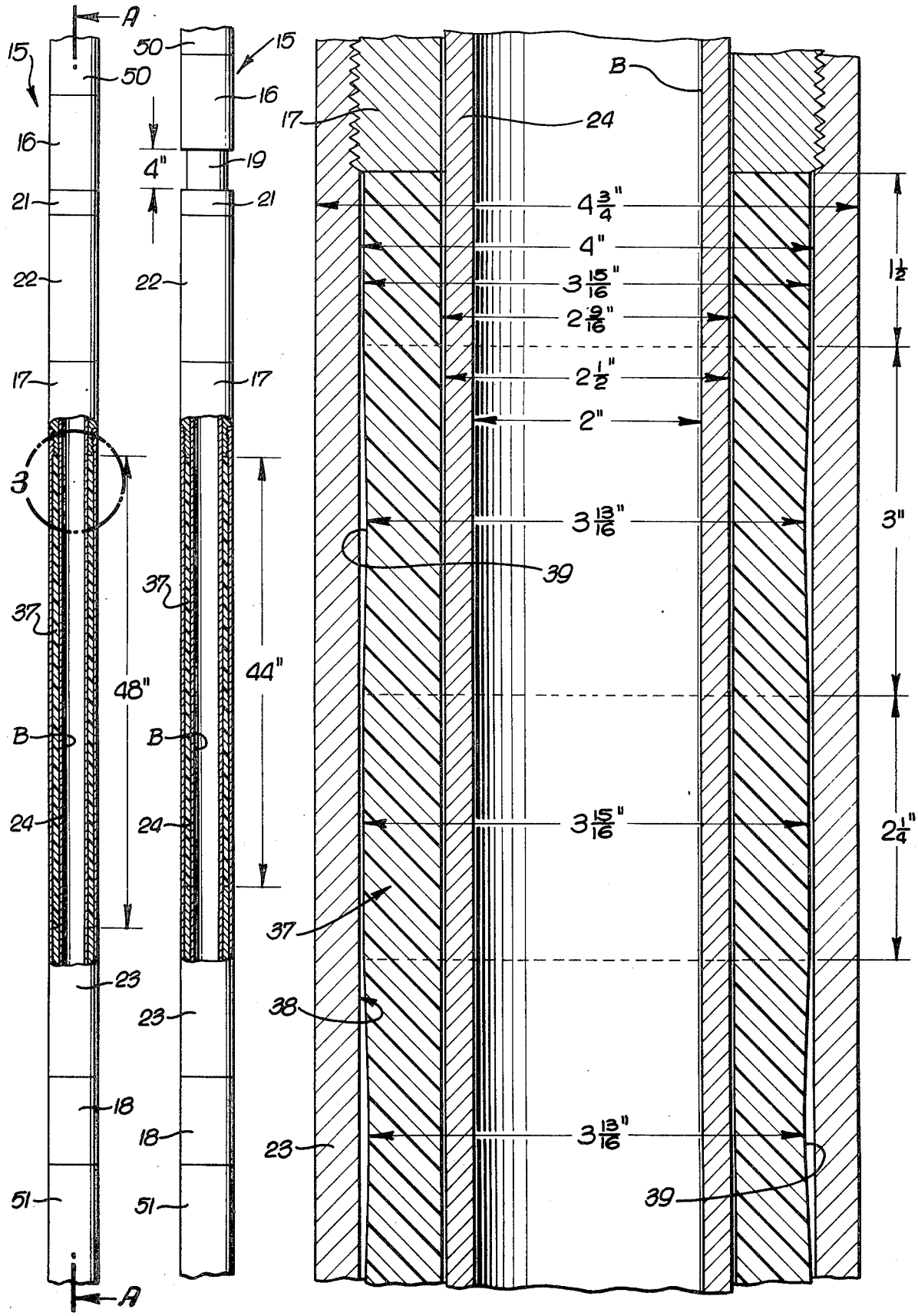
FIG. 1 is a fragmentary vertical elevational view of a drill string embodying a preferred embodiment of the invention and partially in section to illustrate in its full length the molded polymer elastic tubular element of the invention under its normal minimal compression.
FIG. 2 is a view similar to FIG. 1 showing the invention telescopically extended to subject the polymer elastic element to a maximum degree of compression.
FIG. 3 is an enlarged (full-scale) fragmentary vertical sectional view taken of the circled area 3 in FIG. 1 and illustrates dimensionally a typical portion of said polymer elastic element while the latter is subjected to its minimal compression in the invention.
Figure 4:
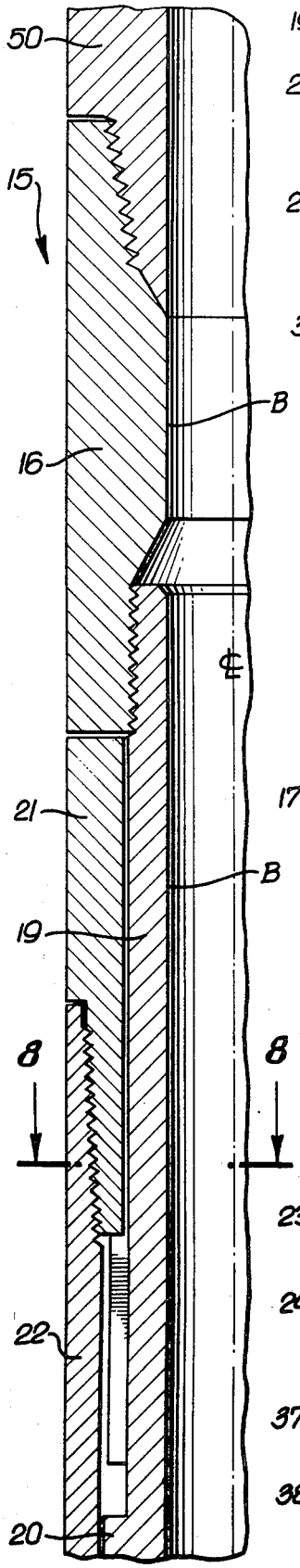
FIGS. 4, 5, 6 and 7 comprise enlarged left half sectional views of successive portions of the invention proceeding, in order, from the upper end to the lower end of FIG. 1 and are taken on the line A—A of FIG. 1.
Figure 5:
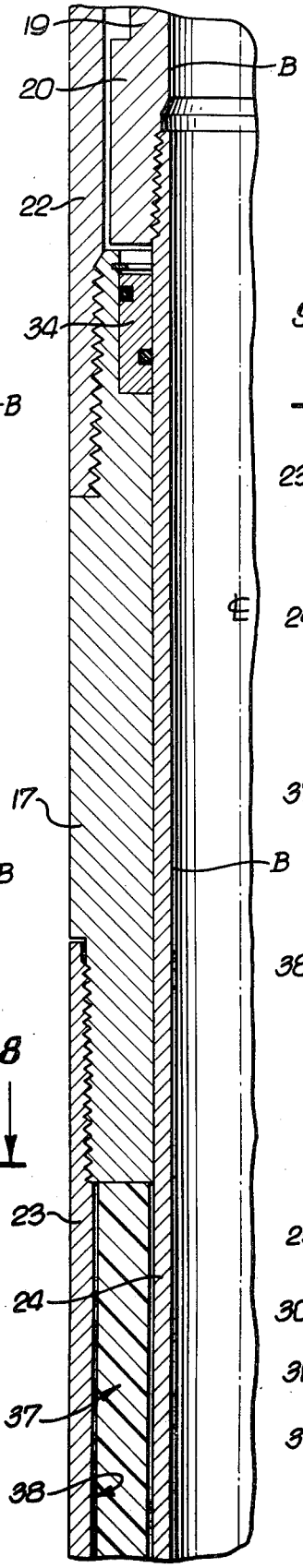
Figure 6:
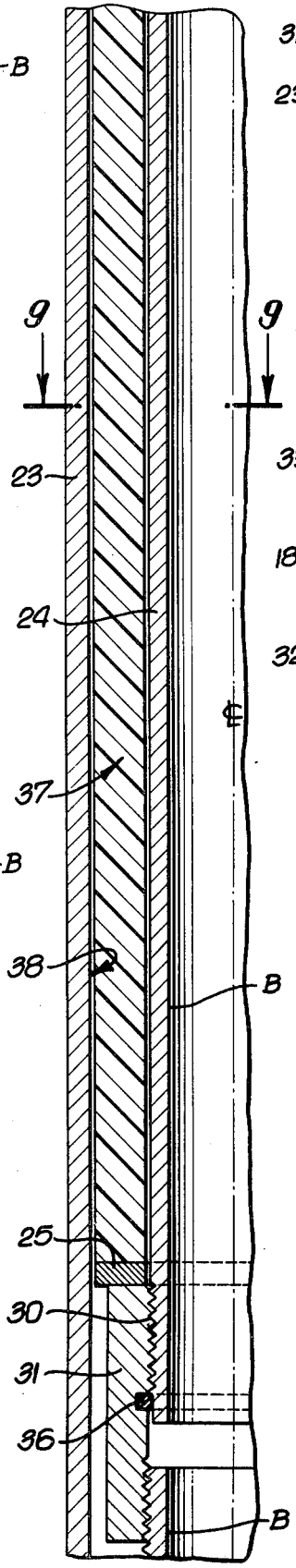
Figure 7:
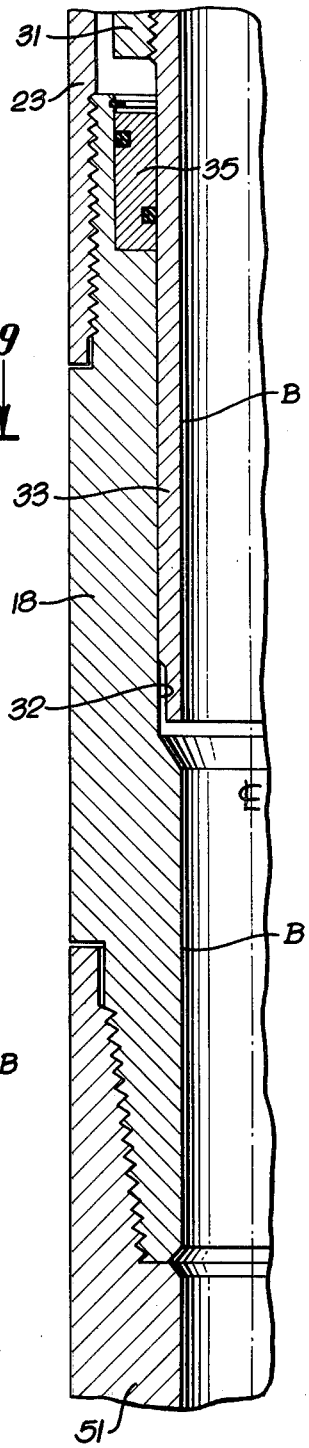

The invention is preferably embodied in a fishing tool energizer 15 having an upper sub 16, an intermediate sub 17, a lower sub 18, an externally splined internal mandrel section 19 having an external annular stop shoulder 20 at its lower end and screwing at its upper end into said upper sub. An internally splined stop collar 21 slides vertically on said splined mandrel section in splined relation therewith and a ported collar 22 screws at its upper end on said stop collar and extends downward below said internal splined section to screw onto the upper end of said intermediate sub.

A relatively thin walled external mandrel 23 is screwed at its upper end onto the lower end of said intermediate sub and at its lower end onto the upper end of said bottom sub. A relatively thin walled internal mandrel 24 is screwed at its upper end into the lower end of said splined internal mandrel section 19.

A ring 25 is vertically adjustably supported on threads 30 provided on the lower end of said internal mandrel 24 by a nut 31 screwed onto said threads, a counterbore 32 being provided in said bottom sub 18. A short extension 33 of said internal mandrel is externally threaded at its upper end and screws into the bottom end of nut 31 so that said extension is slideably received in counterbore 32. An annular seal means 34 is recessed into the upper end of intermediate sub 17 to form a tight seal between said sub and the upper end portion of internal mandrel 24. Another annular seal means 35 is recessed into the upper end of lower sub 18 to form a fluid tight seal between said sub and downward extension 33 of the internal mandrel 24. An O-ring 36 is also recessed into the inner bore of nut 31 so as to make a fluid tight seal between said nut and the lower extremity of the internal mandrel 24.

The fishing tool energizer 15 has a uniform outside diameter of 4¾ inches. The parts of this energizer are so correlated in their design that the upper sub 16, the lower sub 18, the splined internal mandrel section 19 and the thin walled internal mandrel 24 including its downward extension 33 are provided uniformly with co-axial fluid passage bore B of 2 inches inside diameter which represent 42.1% of the uniform outside diameter of the tool of 4¾ inches. react As before pointed out, it is one of the principal objects of the present invention to provide a fluid passage through the tool which represents uniformly a percentage of 42.1% of the outside diameter of the tool. To do this, a considerable restriction was necessary in the space made available in the tool for receiving a power element 37. The annular chamber 38 left for this purpose is provided between the relatively thin walled external and internal mandrels 23 and 24 and extends vertically 48 inches between the ring 25 and the lower end of the intermediate sub 17. To attain the other objects of the invention, the power element 37 must not only fit into this relatively confined annular chamber but it must be of a material which is inherently elastic and yet be of a hardness rendering it able to withstand the application of tremendous axial pressures repeatedly and reach rapidly when said pressure is released with an expansive application of the energy stored therein to accomplish an effective jarring operation.

The only material discovered in researching for the design of this invention, which would meet the demands of all of the aforesaid objects when adopted for the power element 37, is a cylindrical tube of "double bond" polyurethane molded to fit within the annular chamber 38 with the relatively small clearance of one-thirty-second of an inch from each of the mandrels 23 and 24 and making a flat face-to-face contact at its upper and lower ends with intermediate sub 17 and ring 25. The energizer 15 may be readily designed to vary the distance of telescopic travel available between the internal mandrel 24 and the intermediate sub 17, and ring 25 on the one hand and external mandrel 23 and lower sub 18 on the other hand. The energizer 15 is shown in the drawings as having a capacity for telescopic action of 4 inches and this may of course, if desired, be altered to be as much as 6 inches, although in the preferred embodiment, a maximum travel of 4 inches is all that is required.

A shop laboratory test of the invention with the power element 37 molded as above described with true cylindrical external and internal surfaces uniformly spaced from the confining spaces of the annular chamber 38 by a distance of one-thirty-secondth of an inch, the following data was recorded:

| | |
|---|---|
| 2" travel | 20,000 pounds |
| 2¼" travel | 40,000 pounds |
| 2½" travel | 55,000 pounds |
| 2¾" travel | 69,000 pounds |

The tool was then disassembled and nine shallow annular concavities (or flutes) 39 were turned in the outer cylindrical face of the power element 37 each of which concavities or flutes covers approximately a 3 inch band around the outer surface of element 37, the endmost flutes starting 1½ inches from opposite ends of power element 37 and adjacent flutes being spaced apart uniformly by a distance of 2¼ inch. Each of the annular flutes 39 tapers gradually from its upper and lower limits to the middle of the flute where the latter has a radical depth of one-sixteenth of an inch, as clearly indicated by the large scale (full size) view of FIG. 3.

Following the modification of the external cylindrical surface of the power element 37 as above described and clearly shown in FIG. 3, another laboratory test was performed with the fishing tool energizer 15 with the following results:

| | |
|---|---|
| 2" travel | 10,000 pounds |
| 2¼" travel | 14,000 pounds |
| 2½" travel | 16,000 pounds |
| 3" travel | 30,000 pounds |
| 3½" travel | 55,000 pounds |
| 3¾" travel | 69,000 pounds |

It is estimated that an energizer 15 designed to have a travel of 4½ to 5 inches would permit a compression of power element 37 of approximately 135,000 pounds. We do not anticipate a demand in the drilling industry for a tool with a greater capacity than 115,000 pounds. From the practice with the invention to date in the field, the form of the power element 37 shown in FIG. 3 and above described appears to be preferable over all other forms tried out.

Figure 10:
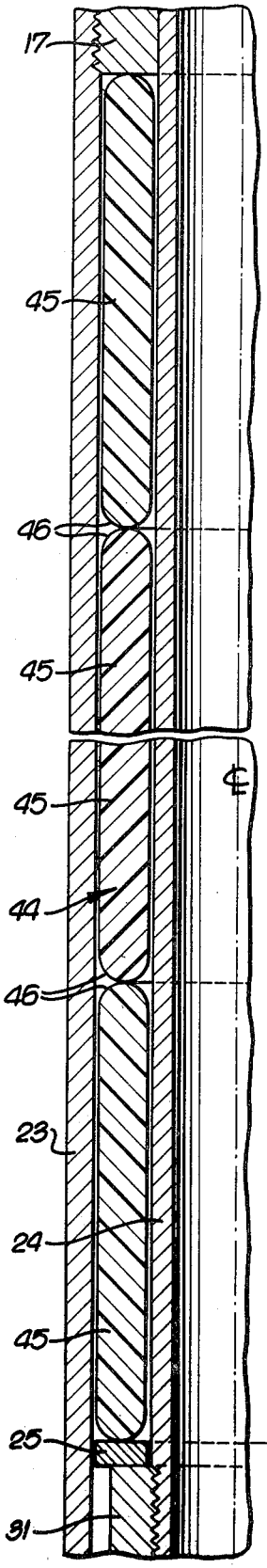
FIG. 10 is a half-scale left half sectional view of a portion of the invention incorporating a modified form of the polymer elastic element thereof, with said element subjected to a minimal degree of compression.
Figure 11:
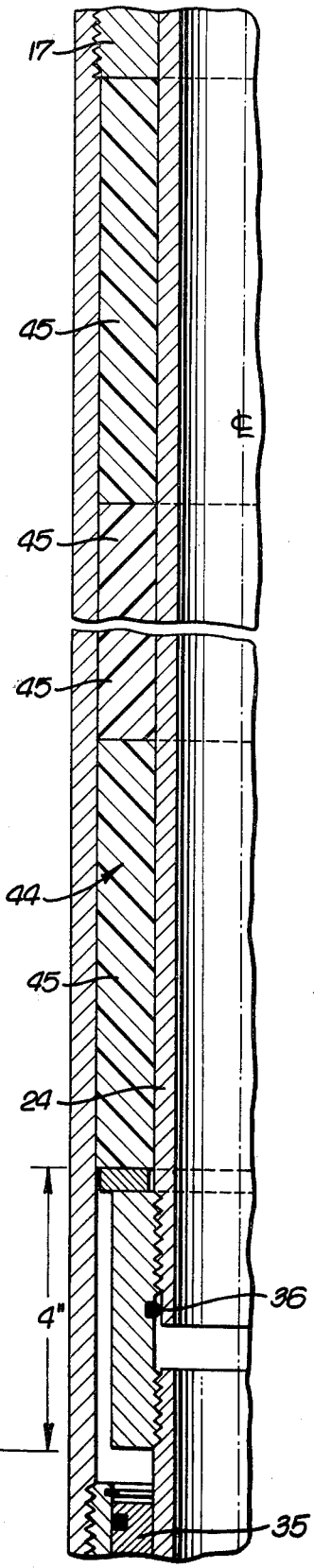
FIG. 11 is a view similar to FIG. 10 wherein said modified polymer elastic element is shown when subjected to a maximum degree of compression.
Figure 8:
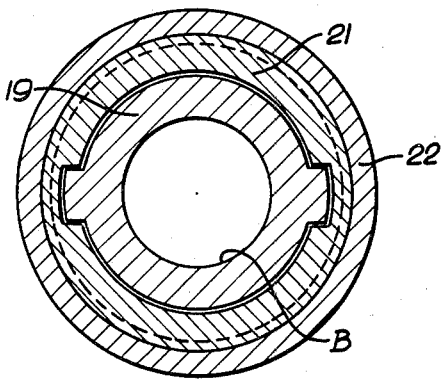
FIG. 8 is a cross sectional view taken on the line 8—8 of FIG. 4 illustrating the spline mechanism of the invention.
Figure 9:
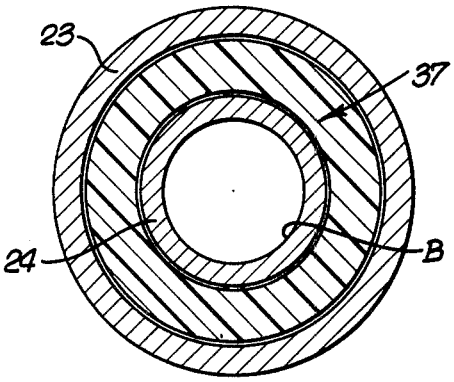
FIG. 9 is a cross sectional view taken on the line 9—9 of FIG. 6 and illustrates the close but free sliding clearance between said tubular polymer elastic element and the inner and outer tubular mandrels confining the same.

A modified form 44 of the power element 37, however, is illustrated in FIGS. 10 and 11 and the response of this to laboratory tests is approximately equivalent to the data of the second test shown above. The power element 44, instead of being a single tubular element 48 inches long, comprises a corresponding length of material which is divided in a lathe into a series of as many as 12 or more short rings 45 which are rounded at 46 at each of their opposite ends so as to increase the elasticity with which the modified power element 44 responds to the high pressure imposed thereon by the tool 15.

As indicated in FIG. 11, a total telescopic movement of 4 inches is accomplished in compressing the modified power element 44 so as to flatten opposite ends of each of the short rings 45, and this requires the application to the energizer of a pressure of 69,000 pounds.

Before assembling the energizer 15, the chamber 38 and the power element 37 are preferably lubricated by spraying or brushing the surfaces of each with a thin coating of S.T.P. which is the trademark of STP Corporation of 1400 W. Commercial Blvd., Fort Lauderdale, Florida, for a product described as "Andy Granatelli's S.T.P. Oil Treatment". This material, marketed as an additive for increasing the lubricating character of commercial lubricants, is a very effective lubricant used by itself in chamber 38 of the tool 15.

As aforenoted, the invention is normally suspended for use in a deep oil well on the lower end of a drill string 50 on which the upper sub 16 is screwed. Suspended on the lower end of the energizer 15 by screwing the same to the lower sub 18 thereof is a fishing tool assembly 51 which is not shown in detail, being no part of the present invention.

I claim:

1. An elastic element for regular service in a deep well energy storing tool for subjection at its opposite ends to a mechanically applied axial compression ranging from 10,000 pounds to 125,000 pounds, with rapid recovery memory and return to starting form when released, said element comprising:

an approximately cylindrical tube molded of polyurethane with a durometer hardness within the range of 80 to 100, said tube having a wall thickness of approximately 0.18 its outside diameter and a length approximately 12 times its outside diameter, and wherein the inner and outer surfaces thereof are approximately concentrically cylindrical throughout excepting for the provision sequentially, in a least one of said surfaces, of a series of very shallow annular flutes, each of said flutes having a maximum depth of approximately two hundredths of the axial length of said flute.

2. An element as recited in claim 1 wherein said flutes are formed at uniformly spaced intervals in the external cylindrical surface of said element and occupy, in the aggregate, at least one-half the external surface of said element.

3. An element as recited in claim 2 wherein said flutes have a maximum radial depth of approximately one-sixteenth of an inch, at the midpoint therein, and are individually approximately 3 inches long in an element having an outside diameter of approximately 4 inches, the radial depth of each flute decreasing gradually to zero at the upper and lower ends of said flute.

4. An element as recited in claim 3 wherein said element has a length approximately 12 times its outside diameter and approximately 19 times its inside diameter and, with a durometer hardness of 85, yields one-twelfth its length under a co-axial compressive force of 70,000 pounds, and, when released, dynamically recovers its beginning length with a counter thrust equivalent in energy to said compressive force.

5. A fishing tool energizer employing a tubular molded polymer column for the axial storage of elastic energy by the mechanical axial compression of said column, said energizer comprising:

an upper sub;

an intermediate sub;

a lower sub;

an externally splined internal mandrel section having an external annular stop shoulder at its lower end and screwing, at its upper end into said upper sub;

internally splined stop collar means vertically slideable on said splined mandrel section;

ported collar means secured at its upper end on said stop collar means and extending downward below said internal splined section to screw onto the upper end of said intermediate sub;

a relatively thin walled external mandrel screwed at its upper end onto the lower end of said intermediate sub and at its lower end onto the upper end of said lower sub;

a relatively thin walled internal mandrel screwed at its upper end into the lower end of said externally splined internal mandrel section;

a ring slideably fitting in the annular chamber formed between said thin walled internal and external mandrels, said ring being vertically adjustably supported on threads provided on the lower end of said internal mandrel by a nut screwed onto said threads, there being a counterbore formed in said lower sub with the same diameter as the bore of said intermediate sub in which said internal mandrel slidingly fits;

a short extension of said internal mandrel, externally threaded at its upper end, said extension screwing into the bottom end of said nut and being slideably received in said lower sub counterbore; and an elastic energy storage element comprising a cylindrical tubular molded column of polyurethane fitting, with approximately one thirty-secondth of an inch radial clearance, both externally and internally, within the annular space enclosed by said relatively thin walled external and internal mandrels and with said element touching said ring and said intermediate sub at the lower and upper ends of said element.

6. A fishing tool energizer as recited in claim 5 wherein said entire tool is uniform in outside diameter and wherein said upper sub, said lower sub, said splined internal mandrel section, and said thin walled internal mandrel with its downward extension are provided uniformly with fluid passage bores with an inside diameter which is approximately 42 percent of said outside diameter.

7. A fishing tool energizer as recited in claim 5 wherein annular seal means are recessed into the upper end of said intermediate sub and into said lower sub for making a sealing engagement between said subs and said internal mandrel for confining lubricant coating the chamber occupied by said polymer column and excluding contaminants therefrom.

* * * * *

UNITED STATES PATENT OFFICE

CERTIFICATE OF CORRECTION

Patent No. 3,980,146 Dated September 14, 1976

Inventor(s) Wayne N. Sutliff et al.

It is certified that error appears in the above-identified patent and that said Letters Patent are hereby corrected as shown below:

Column 5, line 18, "a" should read -- at --.

Signed and Sealed this

Twenty-first Day of December 1976

[SEAL]

*Attest:*

RUTH C. MASON
*Attesting Officer*

C. MARSHALL DANN
*Commissioner of Patents and Trademarks*